United States Patent [19]

Finger

[11] 4,197,698

[45] Apr. 15, 1980

[54] FLUID-TIGHT WATCH CASE

[76] Inventor: Hansjörg Finger, Standweg 6, 2543 Lengnau (Berne), Switzerland

[21] Appl. No.: 970,440

[22] Filed: Dec. 18, 1978

[30] Foreign Application Priority Data

Dec. 30, 1977 [CH] Switzerland ..... 16335/77

[51] Int. Cl.[2] ..... G04B 37/08; G04B 39/00

[52] U.S. Cl. ..... 368/291; 368/295

[58] Field of Search ..... 58/88 R, 90 R, 91

[56] References Cited

U.S. PATENT DOCUMENTS

| | | | |
|---|---|---|---|
| 3,950,937 | 4/1976 | Fujimori | 58/90 R |
| 4,110,970 | 9/1978 | Fanazawa et al. | 58/90 R |

FOREIGN PATENT DOCUMENTS

| | | | |
|---|---|---|---|
| 379406 | 8/1964 | Switzerland | 58/90 R |
| 585928 | 3/1977 | Switzerland | 58/90 R |

*Primary Examiner*—Edith S. Jackmon

*Attorney, Agent, or Firm*—Stevens, Davis, Miller & Mosher

[57] ABSTRACT

In a two-piece, round or shaped fluid-tight watch case, a combined caseband-and-bezel is fixed to the wall of a domed back by means of a snap-fitting or of gripping. A gasket is accommodated in an outer peripheral undercut situated along the top edge of the wall of the domed back and is pressed obliquely by an inclined surface exhibited by the caseband-bezel at the periphery of the undersurface of a flange. Since the undersurface of the glass is plane, the thickness of the flange determines the height of the space left for the hands.

6 Claims, 2 Drawing Figures

FLUID-TIGHT WATCH CASE

Figure 1:
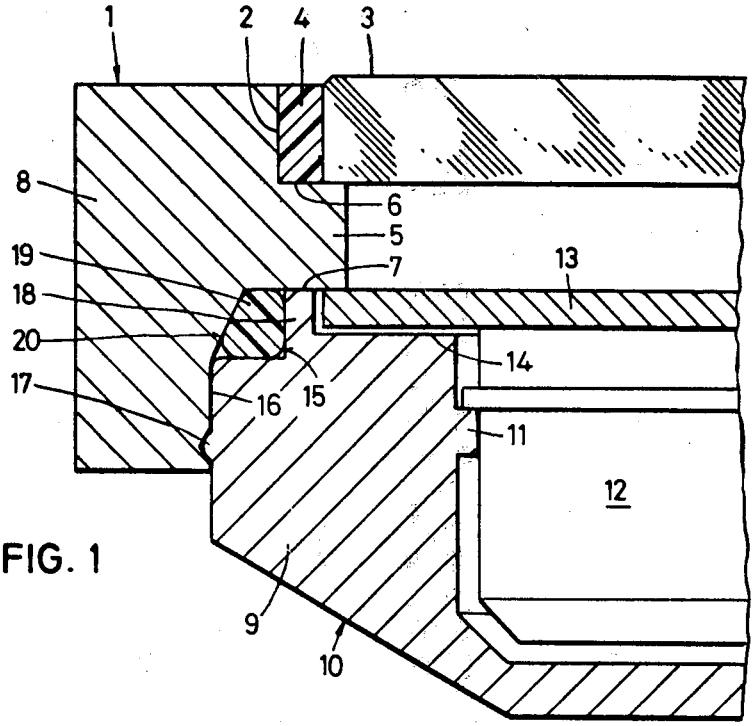

This invention relates to a fluid-tight watch case of the type comprising a combined caseband-and-bezel provided with an inner flange for positioning the dial, a domed back provided with a sidewall on which the case-band-and-bezel is fitted, and an annular gasket disposed between the caseband-and-bezel and the back at least at the level of the dial.

Designs of this type are known to present a particular advantage in that the gasket is situated substantially at the level of the upper face of the movement, or even higher. The wall of the domed back is therefore completely free over the entire height of the movement; and if the latter is of reduced thickness, so that the control stem takes up a proportionally large space relative to the thickness of the movement, it is not necessary to make the elements of the case thicker in order to provide means for ensuring fluid-tightness. In other words, such designs make it possible to produce very thin cases for movements which are themselves very thin.

In some of these cases, particularly those described in Swiss Pat. Nos. 220,262, 241,957, and 386,934, some of which are round and others non-round, the gasket is compressed axially by the upper face of the domed back against a shoulder of the caseband-bezel or against the rim of the glass. In Swiss Pat. No. 585,928, which relates to a non-round case, the gasket is compressed between the bevelled outer side face of the domed back and the wall of the caseband-bezel.

Whereas, in the first three of the aforementioned patents, the axial compression of the gasket requires very particular care at the time of casing-up and makes it very difficult or impossible to produce a simple snap closing, the design described in Swiss Pat. No. 585,928 tends to remedy this drawback by providing a partially radial compression of the gasket. The bevelled outer side face of the domed back exerts a force having a centrifugal component upon the gasket, and this decreases the reaction in the axial direction. It has been found, however, that this arrangement is liable to cause exaggerated local compressions, as a result of the wedge effect, and to deform the case.

It is an object of this invention to provide a watch case of the type initially mentioned, the overall height of which can be even further reduced as compared with prior art cases, which avoids the risks and shortcomings resulting from a snap fastening or a simple grip fastening when the gasket is compressed solely in the axial direction, and which likewise eliminates the drawbacks mentioned in connection with the last of the aforementioned patents.

To this end, in the watch case according to the present invention, of the type initially mentioned, the caseband-and-bezel includes an inclined annular inner surface, and the sidewall of the back includes a peripheral outer undercut having sides formed by an annular shoulder and by the side face of a rib pressing against the flange of the caseband-and-bezel, the gasket being compressed radially and obliquely by the inclined surface of the caseband-and-bezel and pressing against the sides of the undercut.

One of the particular advantages of this invention is that the case can be produced in the form of a round case as well as in the form of a rectangular case, a square case, a case having rounded sides, etc.

Figure 2:
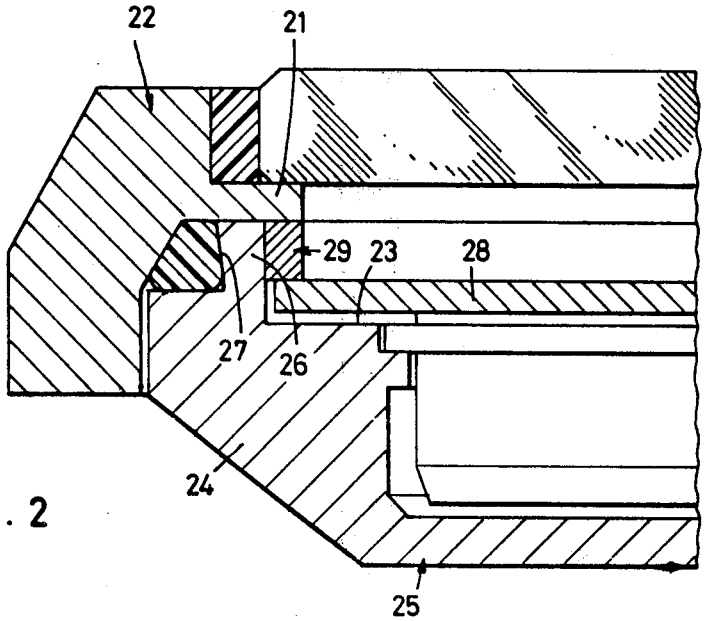

Two preferred embodiments of the invention will now be described in detail, by way of example, with reference to the accompanying drawing, in which:

FIG. 1 is a partial axial section through a watch case according to the invention, and FIG. 2 is an analogous view of another embodiment.

The wach case shown in FIG. 1 may just as well be round in shape as rectangular, square, or some other shape. The horns for fixing the case to the watchband or bracelet are not shown. They are made in one piece with a combined caseband-and-bezel 1 which has in its plane upper surface an inner undercut 2 of rectangular cross-section, intended to receive a glass 3. The latter is of mineral glass or of a transparent stone such as sapphire, for example. It is fixed in the undercut 2 by the interposition of an annular member 4 of plastic material which is gripped between the edge of the glass 3 and the side of the undercut 2 so as to hold the glass 3 in place and to make the joint between the parts 1 and 3 fluid-tight.

As may be seen from the drawing, the caseband-bezel 1 is machined with an annular inner projection 5 of rectangular cross-section which constitutes the flange and which is bounded at the top by the plane bottom surface 6 of the undercut 2 supporting the gasket 4 and the glass 3. At the bottom, the flange 5 is bounded by a plane annular under surface 7.

The casebound-bezel 1 further includes a sidewall element 8 which, upon closing of the case, fits around a sidewall 9 of a domed back 10. The latter is a conventional component of two-piece watch cases. The wall 9 includes an inner fillet 11 intended to support a movement 12, while a dial 13 which extends beyond the movement 12 fits in a flat-bottomed annular recess 14 made in the upper face of the wall 9.

This upper face of the wall 9 is machined to include not only the annular recess 14 but also a peripheral outer undercut 15 bounded by a flat bottom surface and a cylindrical peripheral surface, the two surfaces forming between them a dihedral angle of 90°, the apex of which takes the tangible form of an interior edge running all the way around the domed back 10.

It is on a cylindrical outer side face 16 of the wall 9 that the wall element 8 of the caseband-bezel 1 fits. An annular projection 17, corresponding to a groove in the inner face of the wall 8, makes it possible to fix the caseband-bezel 1 to the domed back 10 in a position such that the undersurface 7 of the flange 5 presses on the top surface of a rib 18 of rectangular cross-section, bounded by the sides of the undercut 15 and the recess 14. Thus, the positioning in height of the back 10 relative to the caseband-bezel 1 is accurately determined, and the movement 12 is held in place by pressure of the periphery of the dial 13 against the shoulder 7.

The joint between the parts 1 and 10 is made fluid-tight by means of a toroidal gasket 19 of elastomer fitted in the undercut 15. In order to compress the gasket 19 and ensure good fluid-tightness, the caseband-bezel 1 includes an inclined surface 20 between the shoulder 7 and the inside surface of the wall element 8. The angle of inclination of the surface 20 to the axis of the movement 12 is about 30°, and the surface 20 extends up to and joins the undersurface 7 of the flange 5.

When the case is closed, the toroidal gasket 19 is compressed by the inclined surface 20 so that the reaction force due to the compression of the gasket, which tends to separate the two parts 1 and 10 from one another, is exerted in a direction inclined at an angle of about 30° to a plane perpendicular to the axis of the case. Hence this reaction is directed in a preponderantly radial direction, which eliminates the risk of untimely opening of the case.

The inclined inner surface 20 may be made in various ways. In a round case, it may naturally be profile-turned. In shaped cases, on the other hand, this inclined surface may be made by milling if the radii in the angles are not too small. There is, however, another method of making this inclined surface, which method consists in forming the whole caseband-bezel 1 by stamping. Thus, inclined inner surfaces 20 may be obtained even if a very small radius is provided in the angles. It will be noted that this inclined inner surface extends to the same level as the dial. The hole for the stem can therefore be made in the wall 9 below the undercut 15. A simple semicircular notch in the bottom of the wall element 8 may correspond to this hole. As for the undercut 15 in the part 10, it may be machined by milling with a disc-cutter, even when the part 10 is rectangular or square in shape.

FIG. 2 shows an embodiment differing slightly from that of FIG. 1. Here, a flange 21 of a combined caseband-and-bezel 22 is made as thin as possible. In compensation, a flat-bottomed undercut 23 made in the upper part of a wall 24 of a domed back 25 is deeper than in the first embodiment. Hence a rib 26 and an undercut 27 are situated at a higher level than a dial 28, making it possible to reduce the thickness of the case still further and to accommodate therein thinner movements of the analog type. To hold the movement, a fitted flange 29 is provided to the inside of the rib 26.

What is claimed is:

1. A fluid-tight watch case comprising a combined caseband-and-bezel provided with an inner flange for positioning the dial, a domed back provided with a sidewall on which said caseband-and-bezel is fitted, and an annular gasket disposed between said caseband-and-bezel and said back at least at the level of said dial, wherein said caseband-and-bezel includes an inclined annular inner surface and said sidewall includes a peripheral outer undercut having sides formed by an annular shoulder and by the side face of a rib pressing against said flange, said gasket being compressed radially and obliquely by said inclined surface and pressing against said sides of said undercut.

2. A watch case in accordance with claim 1, wherein said inclined inner surface is bounded at the top by a plane annular surface forming the undersurface of said flange.

3. A watch case in accordance with claim 1 or claim 2, wherein said rib of said domed back extends around the periphery of said dial.

4. A watch case in accordance with claim 3, wherein said periphery of said dial is fitted in an annular recess made in the edge of said sidewall of said domed back, said recess being bounded towards the outside by said rib.

5. A watch case in accordance with claim 1, wherein said caseband-and-bezel is snap-fixed to said sidewall of said domed back.

6. A watch case in accordance with claim 1, wherein said caseband-and-bezel includes a wall element bounded on the inside by a cylindrical surface directly joining said inclined surface.

* * * * *